US011664004B1

(12) United States Patent
Wang et al.

(10) Patent No.: US 11,664,004 B1
(45) Date of Patent: May 30, 2023

(54) ACTIVE NOISE CANCELLATION OF TONAL NOISE BY MANIPULATING CHARACTERISTIC ACOUSTIC MODES

(71) Applicant: Gulfstream Aerospace Corporation, Savannah, GA (US)

(72) Inventors: Tongan Wang, Savannah, GA (US); Brian G. Cook, Savannah, GA (US); Scott Bohanan, Savannah, GA (US); Jim Jordan, Savannah, GA (US)

(73) Assignee: Gulfstream Aerospace Corporation

( * ) Notice: Subject to any disclaimer, the term of this patent is extended or adjusted under 35 U.S.C. 154(b) by 0 days.

(21) Appl. No.: 18/054,007

(22) Filed: Nov. 9, 2022

(51) Int. Cl.
*G10K 11/178* (2006.01)

(52) U.S. Cl.
CPC .. *G10K 11/17854* (2018.01); *G10K 11/17883* (2018.01); *G10K 2210/1281* (2013.01)

(58) Field of Classification Search
None
See application file for complete search history.

(56) References Cited

U.S. PATENT DOCUMENTS 4,562,589 A * 12/1985 Warnaka ..... G10K 11/17854 381/86
2005/0053144 A1* 3/2005 Holcomb ..... H04N 19/16 375/E7.138

* cited by examiner

*Primary Examiner* — Kenny H Truong
(74) *Attorney, Agent, or Firm* — LKGlobal | Lorenz & Kopf, LLP

(57) ABSTRACT

To reduce engine noise in the cabin of an aircraft a plurality of error microphones is deployed at predetermined locations within the cabin to produce error microphone response signals associated with the engine noise in the cabin. Engine vibration inputs are obtained from sensors coupled to the aircraft engines. A processor is used to code the error microphone response signals into an encoded modal response in the cabin through a coding matrix. A processor is used to apply an adaptive filter to determine a plurality of modal signals needed to cancel the encoded modal response in the cabin. A processor is used to decode the modal signals into speaker input signals through a decoding matrix. Speaker input signals are then sent to a plurality of speakers to reduce the engine noise in the cabin.

14 Claims, 6 Drawing Sheets

ACTIVE NOISE CANCELLATION OF TONAL NOISE BY MANIPULATING CHARACTERISTIC ACOUSTIC MODES

TECHNICAL FIELD

This disclosure relates generally to active noise cancellation in enclosed spaces. More particularly the disclosure relates to cancellation of tonal noise inside an aircraft cabin by active cancellation of the acoustic response to plural different modal characteristics of the cabin interior.

BACKGROUND

This section provides background information related to the present disclosure which is not necessarily prior art.

During flight, jet engines produce vibrations which are mechanically coupled through attachment structures to the fuselage of the aircraft. These vibrations, if left unchecked, will fill the cabin with low frequency noise, which tends to be louder in regions of the cabin which are closer to the engine attachment points.

Current active noise cancellation technology typically comes in the form of personal noise-cancelling headsets or earbuds. These work by sensing the ambient noise at a point very near the wearer's ear and injecting cancelling sound that is 180 degrees out of phase with the noise frequencies at the ear. Of course, the noise cancelling effect is immediately lost if the wearer removes the headset or earbud devices. Some have proposed incorporating noise cancelling speaker systems in seat headrests, but such systems are less effective than headsets or earbuds because the occupant, simply by moving the head, can greatly alter the ratio of noise sound to cancellation sound, diminishing the noise cancelling effect.

The requirement to wear noise cancelling headsets or to sit with one's head properly positioned on a noise cancelling headrest can become an annoying encumbrance for passengers, particularly on long flights or when shifting to different comfortable positions during sleep.

The conventional active noise cancellation algorithm relies on minimizing the noise at the error microphone location (e.g., near the ear). While this works well for cancelling noise within a headset, in an enclosed space like an aircraft cabin, cancellation of noise at the error microphone locations will likely amplify the noise at other locations. This renders the conventional active noise cancellation algorithm ineffective for global noise cancellation in an enclosed space like an aircraft cabin.

SUMMARY

Rather than placing a noise cancelling system on or near each passenger's head, the disclosed system approaches the problem from an entirely different perspective. The disclosed system is designed to reduce the overall noise level in the affected area of the cabin. It does this by exploiting knowledge of how the plurality of different resonant modes behave. Specifically, the disclosed system employs a processor which receives sensor inputs located at specific physical positions within the space—at positions where each individual modal pattern exhibits a maximum amplitude response. The dynamic response of a linear system can be characterized as superposition of its resonant modes. Each resonant mode has a characteristic spatial pattern (mode shape) over the entire system. By controlling the responses of all resonant modes in the frequency range of interest, the response of the dynamic system is reduced globally.

As each resonant mode oscillates back and forth in its unique characteristic pattern, certain portions of the vibrating structure or acoustic space exhibit essentially no movement. These are called the nodal points. Certain other portions exhibit maximum vibrational movement. These are called the anti-nodal points. The disclosed system places sensors at or near the anti-nodal points for each of the dominant resonant modes in the frequency range of interest. In this way, the processor is given important real-time information about how all of the relevant resonant modes are behaving relative to one another. This relative behavior can be quite complex. The different resonant modes are not in lock-step synchronism. Thus the anti-nodal points of each mode may not reach maximum movement at the same time.

The system includes a series of speakers positioned and directed so that they will have optimal effect in controlling the acoustic energy of each resonant mode in the frequency range of interest. The sound is precisely generated by the speakers to cancel or diminish the sound produced by other noise sources for at least one of the resonant modes. In some instances, two or more modes may be excited with high sound pressure levels by other noise sources within the same region of space. In these cases, a single speaker can be fed by the processor with an audio signal having frequency content that will substantially cancel out the noise corresponding to each mode response sharing that region of space. In other instances, a single speaker may be positioned and directed to cancel out the response of a single mode.

In all cases, the processor supplies specific audio signals to each speaker individually, at an amplitude, frequency and phase calculated to cancel the noise excited by other sources through a particular resonant mode in that region of space.

According to one aspect, the disclosed method for reducing engine noise in the cabin of an aircraft, having at least one engine, is performed by deploying a plurality of error microphones at predetermined locations within the cabin to produce error microphone response signals associated with the engine noise in the cabin. Additionally, inputs are obtained from at least one reference sensor coupled to at least one engine carried by the aircraft. A processor is used to code the error microphone response signals into an encoded modal response in the cabin through a coding matrix. A processor is used to apply an adaptive filter to determine a plurality of modal signals needed to cancel the encoded modal response in the cabin. A processor is used to decode the modal signals into speaker input signals through a decoding matrix. The foregoing processors may be implemented by separate processor devices, or their functions may be performed by a single processor. Digital signal processors and gate array circuits such as field programmable gate array devices may be used. Speaker input signals are then sent to a plurality of speakers to reduce the engine noise in the cabin.

According to another aspect, an active noise cancellation system and method for reducing engine noise in an aircraft cabin is disclosed. The aircraft cabin has a geometric structure that defines a plurality of different resonant modes each having at least one anti-node.

An engine vibration sensor mechanically coupled to the aircraft produces an engine vibration signal in response to engine vibration. A plurality of error sensors is positioned throughout the cabin at a first set of predetermined locations related to at least one anti-node of the plurality of different resonant modes. The plurality of error sensors produces a plurality of time-varying sound pressure level signals.

A plurality of speakers is positioned throughout the cabin at a second set of predetermined locations related to the at least one anti-node of the plurality of different resonant modes.

A conversion processor programmed to receive the time-varying sound pressure level signals and to produce a modal representation of information carried by the sound pressure level signals as a matrix of modal signals corresponding to each of the plurality of different resonant modes of the cabin. An active noise cancellation processor programmed to operate on the modal signals to compute individual noise cancellation solution signals fed to each of the plurality of speakers.

Although the system is developed to cancel engine tonal noise, it can also be adapted to cancel other noise in the cabin.

BRIEF DESCRIPTION OF THE DRAWINGS

The drawings described herein are for illustrative purposes only of selected embodiments and not all possible implementations. The particular choice of drawings is not intended to limit the scope of the present disclosure.

DETAILED DESCRIPTION

During flight, jet engines produce vibrations which are mechanically coupled through attachment structures to the fuselage of the aircraft. These vibrations cause the interior walls, floor and other connected surfaces to vibrate, resulting in acoustic waves that fill the aircraft cabin with low frequency noise, typically in a frequency range from 30 to 120 Hz. The fuselage being essentially cylindrical in shape, the interior walls and floor define a resonant structure, not unlike a giant organ pipe.

The physics of the aircraft cabin interior are more complex than an organ pipe, however. Engine vibrations are coupled to the fuselage in a manner which causes the interior walls, floor and other connected surfaces to vibrate in a plurality of different resonant modes, which are characteristic of the geometric structure of the aircraft cabin. Induced by engine vibration, the interior cabin walls, floor and other connected surfaces concurrently vibrate at a plurality of different natural frequencies, each being characteristic of a different resonant mode. These resonant modes establish various standing wave patterns in the interior-facing surfaces, and these vibrating surfaces launch acoustic waves emanating from different surface locations within the cabin. Each resonant mode has geometrically defined characteristic nodes (points of minimal movement) and anti-nodes (points of maximal movement). The acoustic waves emanate most strongly from the anti-nodal points of maximal movement, producing the highest sound pressure levels. Similarly, the interior acoustic space inside the cabin also exhibits dynamic modal behavior, and the resulting sound at each location is a superposition of the responses due to each resonant mode inside the cabin.

The net effect of these multiple resonant modes is a rich harmonic mixture of low frequency sound (noise) which can become very fatiguing to the occupants of the cabin. The intensity of this low frequency noise is greatest in regions of the cabin which are closest to the point of attachment of the aircraft engines to the fuselage. Thus, if the engines are mounted near the tail of the aircraft, the objectionable noise will typically be loudest in the aft cabin.

The active noise cancellation of the disclosed system differs markedly from conventional active noise cancellation systems in that the noise cancellation processor is not designed to minimize the response at singular error microphone locations, but to minimize the responses of each dominant acoustic mode for global noise reduction. To understand how this works, an understanding of resonant modes within the aircraft cabin is necessary.

Resonant Modes

Figure 1:
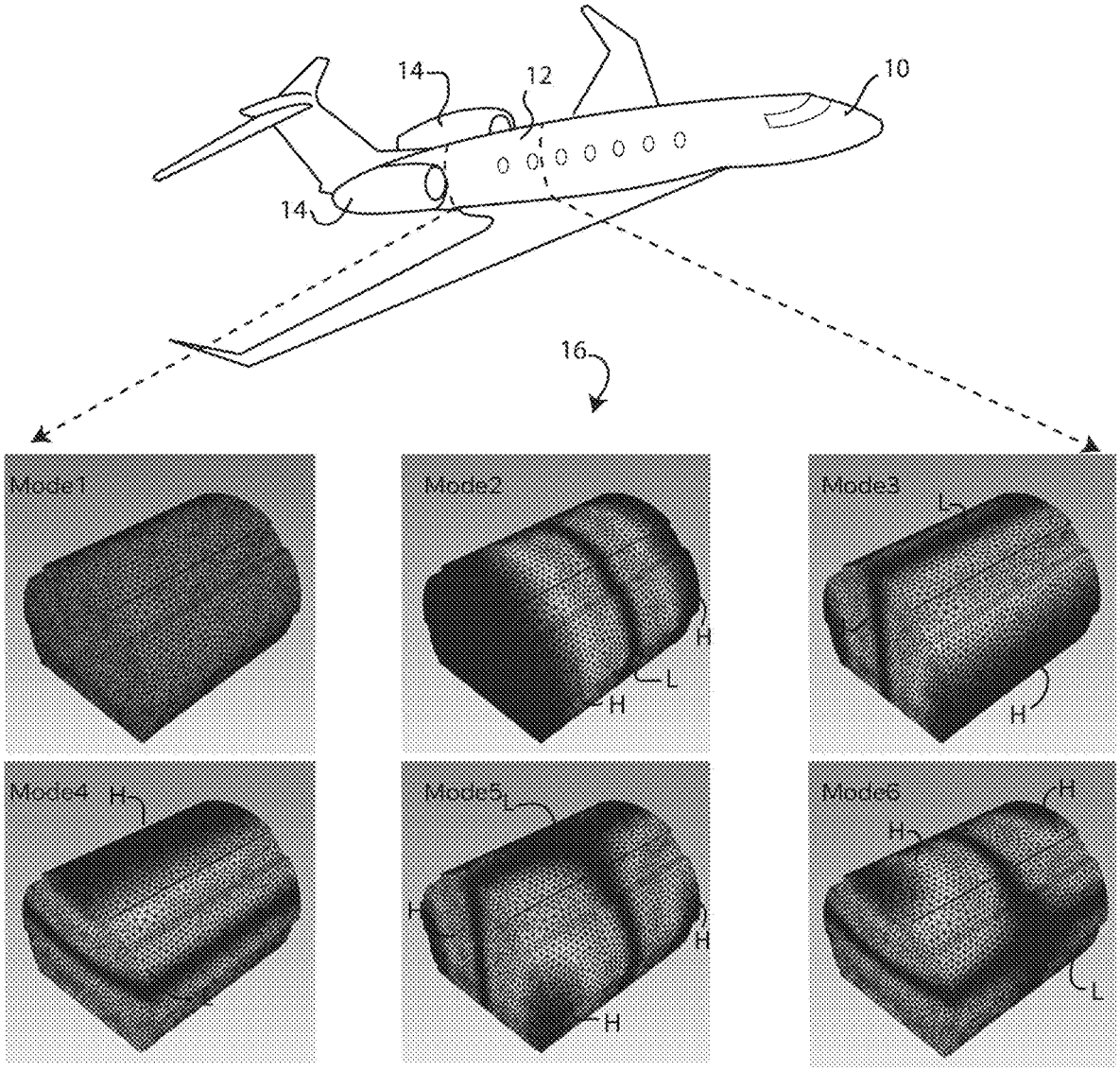
FIG. 1 illustrates six exemplary resonant modes associated with a section of the interior cabin of an aircraft.

FIG. 1 illustrates an exemplary business jet aircraft 10, with the aft cabin region shown at 12. In this aircraft, the engines 14 are attached to the structure of the aircraft near the aft cabin region. Thus low frequency vibrations of the engine are mechanically coupled to the aircraft structure, causing the interior cabin walls, floor and other attached surfaces to vibrate at a plurality of resonant modes according to a plurality of different modal patterns. These modal patterns exhibit standing wave nulls (at the nodes) and peaks (at the anti-nodes) at specific locations along the surface of the interior cabin walls, floor and other attached surfaces. These node and anti-node locations are positionally fixed—dictated by the physical geometry of the cabin—and yet exhibit a time-varying change in amplitude. Specifically, the sound pressure amplitude at the anti-nodal point varies sinusoidally with time at the characteristic frequency of that mode. The maximum sinusoidal change is present at the anti-nodes. In contrast, there is very little if any change in amplitude at the nodal points, as these represent virtual boundary condition points at which virtually no resonant energy is present. Similarly, the interior acoustic space inside the cabin also exhibits dynamic modal behavior, and the resulting sound at each location is a superposition of the responses due to each resonant modes inside the cabin.

In FIG. 1, the pattern identified as mode number 1 may serve as baseline reference. It corresponds to the zero frequency or rigid body mode, sometimes called the breathing mode, where each location responds uniformly with equal amplitude and phase throughout the cabin. Analogizing the acoustic pattern to an electrical signal, mode number 1 would correspond to the DC or static condition.

The remaining mode numbers 2-6 each have modal patterns exhibiting regions of high sound pressure level (at the anti-nodal points) and regions of low sound pressure level (at the nodal points), with the maximum dynamic amplitude (producing the highest sound pressure levels) oscillating sinusoidally at the characteristic frequency of each mode. As discussed above, the dynamic amplitude of the modal oscillation is greatest at the anti-nodal points, and essentially negligible at the nodal points.

FIG. 1 represents a single snapshot in time. The anti-nodal points can be identified as the regions where the high sound pressure levels are achieved. The anti-nodes and nodes are both positionally fixed in space, as dictated by the geometric structure of the cabin structure. Thus the high and low sound pressure regions occupy fixed regions of space. However, as noted, the maximum amplitude of the dynamic response oscillates sinusoidally at the characteristic frequency, which maximum amplitude will be greatest at the anti-nodal points.

For example, mode 2, as illustrated, has two high sound pressure regions designated at H, and one low pressure region designated at L. The anti-nodal points are located where the high pressure region peaks. For the exemplary aircraft fuselage structure illustrated, this pattern corresponds to an acoustic frequency of f2 Hz and may be referred to as the Fwd/Aft mode.

Mode number 3 has two high sound pressure regions designated at H, and one low pressure region designated at L. This pattern corresponds to an acoustic frequency of f3 Hz and may be referred to as the LH/RH mode.

Mode number 4 has one high sound pressure region designated at H, and one low pressure region designated at L. This pattern corresponds to an acoustic frequency of f4 Hz and may be referred to as the Up/Down mode.

Mode number 5 has high sound pressure regions designated at H in the corners, and one low pressure region at L, spanning the top of the cylinder and extending down the sides between the corners. This pattern corresponds to an acoustic frequency of f5 Hz and may be referred to as a corner mode.

Mode number 6 has high pressure sound regions designated at H centered at the top edges, and a low pressure region L, spanning the side of the cylinder and extending across the top and front and rear faces. This pattern corresponds to an acoustic frequency of f6 Hz and may be referred to as a high order mode.

It will be noted from the above example that the anti-nodes of all modes are fixed at certain (different) positions, and that the sound pressure level amplitudes for each mode oscillates at a characteristic frequency. It is typical that f2-f6 are not coincident at the same frequency. Thus the modes do not all reach maximum sound pressure level peaks simultaneously. To measure each mode, microphones (called error microphones) are placed at the corresponding anti-nodal points and measurements from such microphones will capture the amplitude, frequency and phase information which can be used to characterize that mode.

Another thing to note is that in FIG. 1 the H and L sound pressure levels have been represented here using a dB scale for illustration convenience, which masks the phase information from the pressure. For example, the second mode has positive pressure in the forward portion of the cabin and negative pressure in the aft portion, but it's shown as equally two H regions in the figure. The actual modal vector information utilized by a working embodiment does not discard this phase information.

Overview of the Modal Noise Cancellation Technique

By having been placed a priori at or near the anti-nodal points of all relevant resonant modes, the locations of all microphones inside the cabin are known, and the modal vectors of each mode are known to the processor. The processor computes the modal response from each microphone measurement, and from this computes a noise cancelling solution for each mode. In this way a specific noise cancelling signal is fed to each speaker, the solution being computed to reduce the overall sound pressure level at all locations inside the space. The processor computes these solutions by operating in the modal domain. This is accomplished by transforming the time domain microphone data into a matrix representation that represents the microphone data as a family of resonant modes, each of a different characteristic frequency.

In simplified terms, for Mode 1 (first breathing mode) the processor adds mic signals from everywhere and takes an average to get the DC component. For Mode 2, the processor computes the difference or delta between the fwd and aft microphones. In more exact terms, the actual mode spatial pattern is taken into account at each microphone location when converting the mic response to the modal response.

The modal characteristic of the interior space behaves like a spatial filter. For each resonant mode, once the energy is injected into the space, whether it comes from structural vibration or from a noise cancellation speaker, the response will be of the same spatial pattern.

To understand the physics behind how this works, one can envision bending a cantilever beam statically. Whether bent at the free end, or bent at the mid-point, or acted upon by a pressure over its entire surface, the cantilever beam will have the same static deflection pattern, although with different response amplitudes. This static pattern is actually the mode shape of the first bending mode of the cantilever beam. So for this mode, one can apply a cancellation force at the tip location of the beam, disregarding what other sources excite it in the first place, i.e. mid-point excitation, pressure excitation over the entire beam, etc.

In the disclosed modal noise cancellation system, all speakers will excite all the six modes, because they are placed at the anti-node locations of all six modes. This configuration maximizes the effectiveness of the system and minimizes the number of speakers required. Placement of speakers at nodal locations (as opposed to anti-nodal location) renders such speakers ineffective because that speaker won't be able to excite that mode effectively. From a physics standpoint such incorrect speaker placement is similar to trying to excite a cantilever beam at its root—the beam won't respond very well.

Overview of the processor noise cancellation steps

The processor(s) implementing the disclosed modal noise cancellation system perform the following steps:

- First, the error microphone responses are coded into the modal response of the cabin through a coding matrix.
- Next, with inputs from the reference sensors from all the engines, adaptive filters based on the FxLMS algorithm are then used to determine the modal signals needed to cancel the encoded modal response in the cabin.
- These modal signals are then decoded to each speaker input through a decoding matrix.
- Finally, the speaker inputs are sent to the amplifiers to power the speakers.

Exemplary Mic Placement

As discussed above, the mic placement objective is to deploy mics primarily at anti-node positions throughout the cabin, to capture a good representation of each resonant mode throughout the portion of the cabin where active noise abatement is desired. The following list provides an example. Other placement locations are possible. In the example below, 12 mics are deployed.

Example Deployment

Eight mics on bulkhead as follows:

Four on fwd bulkhead (upper & lower)

Four on aft bulkhead (upper & lower)

Two mics at upper—center anti-node on the sidewall

Two mics at lower—center anti-node on the sidewall

In the above placement list, the bulkhead refers to a dividing wall between cabins. The lower side wall location is typically below about waist height. The upper sidewall location is typically above the passenger seating area, containing lighting, call button, airflow gasper nozzle and compartment for drop-down emergency oxygen mask.

Processor-Based Circuit Implementation

Figure 2:
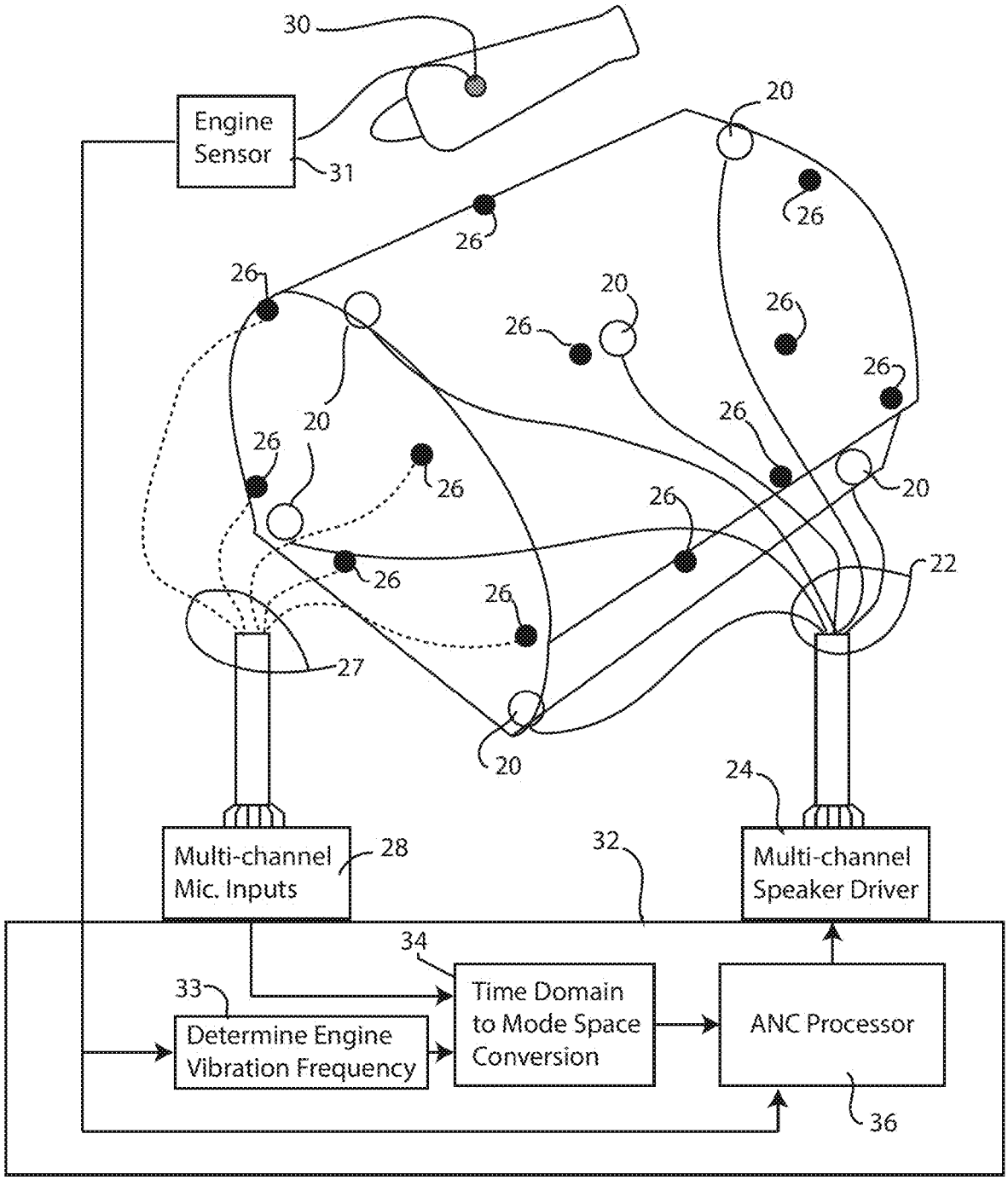
FIG. 2 is a block diagram of the modal active noise cancellation system, illustrating exemplary deployment positions of the error microphones and control speakers.

In FIG. 2, exemplary control speakers 20 and exemplary error mics 26 are illustrated. The control speakers 20 are each individually fed with a customized audio signal via an individual speaker cable 22, which may be bundled at the terminal end where each cable connects to its dedicated port in the multi-channel speaker driver. In one embodiment, the speaker cables 22 carry analog electrical signals produced by the multi-channel speaker driver 24, which applies gain to each signal sufficient to drive each speaker to the proper amplitude, and with the proper phase, as determined by the electronic control system 32. In another embodiment, the speakers may comprise integral digital to analog conversion and analog amplification circuitry, allowing the speakers to be fed with digital signals from the control system 32. In the digital embodiment, the speaker cables 22 may be implemented using fiber optic cable or electrically conductive cable.

The error mics 26 are each connected by individual mic cables 27 to the multi-channel mic input 28. These error mics sample and capture acoustic data indicative of the state of the plurality of resonant modes being monitored by the system. Placement of these error mics at the anti-nodal positions allows the mics to sense the amplitude and phase of the sinusoidally varying sound pressure levels at each anti-node measurement point. In this way, the error mics collectively acquire information about time-varying state of each resonant mode, simultaneously in real time.

In addition to the error mics, the system also includes at least one engine vibration sensor 30, which is secured to a physical structure that is coupled to the engine and which transfers engine vibrations to the cabin. Preferably plural engine sensors will be used, at least one for each engine. The engine sensors may be implemented using an existing engine vibration monitoring (EVM) accelerometer or another accelerometer installed close to the interface between the engine and the aircraft. Since the reference sensors are far from the cabin, this design simplifies the control algorithm by removing the requirement for acoustic feedback neutralization.

The engine vibration sensor(s) may be coupled to an engine sensor sending unit 31, which receives the electrical vibration signal from each engine vibration sensor and processes them by amplifying the raw sensor signal, filtering to remove frequencies which are outside the band of characteristic modal frequencies being manipulated by the system. In addition, the sending unit 31 may also convert the analog engine vibration signal into a digital signal.

Transfer Function Analysis

Figure 3:
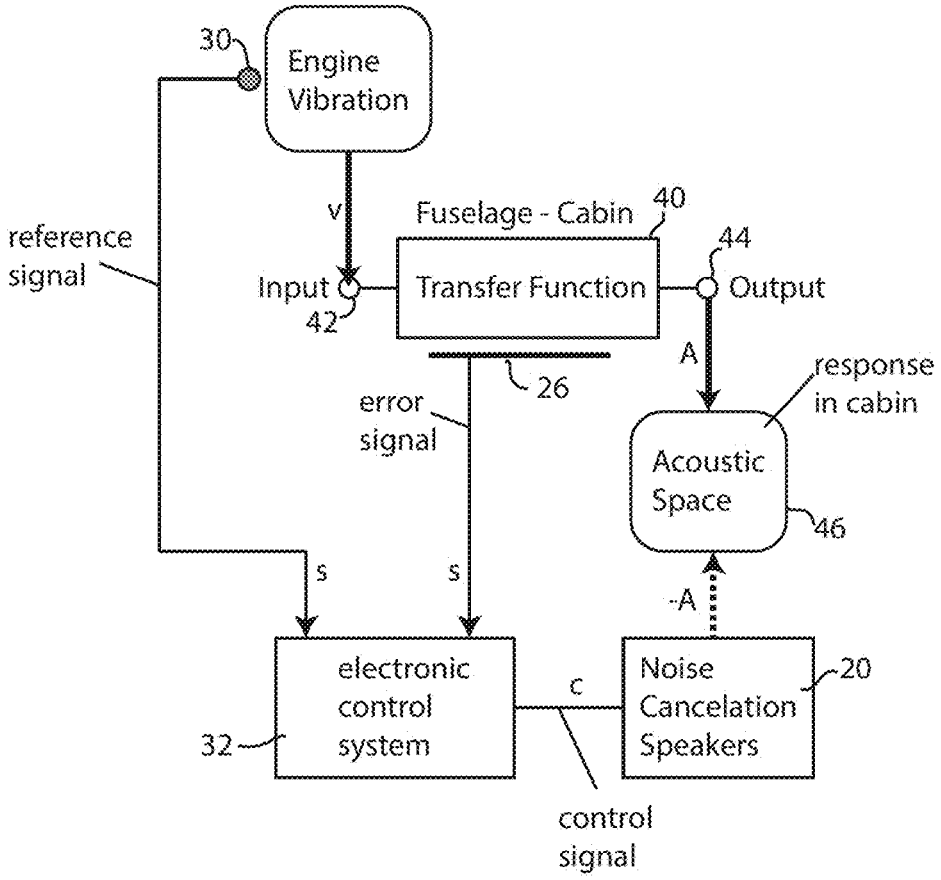
FIG. 3 is a block diagram providing a transfer function analysis of the manner in which engine vibration is communicated as noise into the cabin acoustic space, and illustrating how modal active noise cancellation is used to reduce that noise.

From a system standpoint, the engine vibration sensor signal and the error mic signals and are of a different character. As illustrated in FIG. 3, at a very fundamental level, the disclosed modal-based active noise cancellation system can be modeled as a vibrating elongated tube (the aircraft fuselage and cabin) to which a vibrational input (from the vibrating engine) is applied as input, and which produces an acoustic sound field within the cabin acoustic space 46 as output. Thus the aircraft fuselage and cabin can be represented by a transfer function 40, which converts engine vibration (as input 42) into an acoustic sound field (as output 44) supplied to acoustic space 46 (cabin interior). The active components of the system represent this transfer function 40 in the modal domain and use knowledge of the state of the acoustic sound field in acoustic space 46 (expressed in the modal domain) to inject a noise cancelling acoustic sound field from the speakers.

In FIG. 3, vibrational energy from the engine vibration is represented by bold line v, which is supplied to the input 42 of the fuselage—cabin transfer function 40. The vibrational energy supplied to the fuselage—cabin produces an acoustic energy response at output 44, which is felt and experienced as acoustic noise in the acoustic space 46. In FIG. 3, bold line A represents the delivery of acoustic energy into the acoustic space 46. The objective of the noise cancellation speakers 20 is to deliver noise cancelling acoustic energy into the acoustic space. Thus as illustrated, the noise cancelling energy supplied by speakers 20 is represented by bold dash line-A (the minus sign denoting it is out of phase with the energy A from output 44 of the transfer function).

In FIG. 3, the electronic control system 32 takes electronic signal inputs from the error mics 26 and from the engine vibration sensor 30 and supplies a control signal through line c to the noise cancelling speakers. When reviewing FIG. 3, it should be kept in mind that the transfer function 40 models the response of the fuselage/cabin to engine vibration in producing acoustic noise in the acoustic space inside the cabin. In the general case, this transfer function would normally be expressed in the time domain. That is, the time-varying engine vibration signals would produce a time-varying acoustic noise in the acoustic space of the cabin. However, as will be discussed, the disclosed system performs a transformation of this time domain representation into a modal space representation. As we shall see, the modal space representation allows the active noise cancellation processor 36 (in FIG. 2) of the control system 32 to do a much more comprehensive job of cancelling engine noise throughout the cabin.

Negating all of the different frequencies of noise produced at different locations throughout the cabin is a complex problem due to the fact that the engine vibrations produce an incoherent jumble of many different acoustic responses, at many different frequencies and phases. Moreover, each location within the cabin is different. Thus the time domain jumble at one location is unlikely to appear the same as the time domain jumble at a different location.

However, by transforming the time domain signals into the modal domain, more order over the incoherent jumble is achieved. In the modal domain, a plurality of distinct resonant modes are separated from one another, making it possible for the active noise cancellation processor to operate on each mode separately. Instead of comprising a jumble of randomly emerging frequencies, in the modal domain each mode corresponds to one characteristic frequency. Thus in the illustrated embodiment five discrete modes (plus the sixth DC or breathing mode) are modeled, and they dominate the cabin dynamic behavior in the range of engine vibration frequencies. The active noise cancellation processor is thus programmed to develop out-of-phase noise cancelling control signals to cancel the cabin response due to each of these six modes. The active noise cancellation processor operates at a clock speed that is much greater than the engine vibration frequency. Thus the processor is able to compute solutions for all six modes effectively in parallel.

With reference to FIG. 2, the engine vibration frequency is determined at 33, using the output of engine sensor 31. The conversion from time-domain to modal space-domain is performed by the processor at 34. At each engine vibration frequency, the response of each microphone can be calculated as a superposition of resonant acoustic modes inside the cabin. Since the dynamic behavior in the cabin is dominated by the first 6 acoustic modes in the frequency range of interest, the response of each microphone can be approximated as a superposition of the 6 dominant acoustic modes. Correspondingly, the amplitude of each resonant mode can be derived inversely from the response of the microphones. This transformation may be performed by relating the microphone response to the modal amplitude as a linear system of equations that can be expressed as parameters in a matrix.

In effect, this process starts with a system of equations, representing the microphone response as a superposition of the acoustic modes in the cabin, as shown in Equation (1).

$$\begin{pmatrix} p_1 \\ p_2 \\ \cdots \\ p_m \end{pmatrix} = \begin{bmatrix} M_{11} & \cdots & M_{16} \\ \vdots & \ddots & \vdots \\ M_{m1} & \cdots & M_{m6} \end{bmatrix} \begin{pmatrix} A_1 \\ A_2 \\ \cdots \\ A_6 \end{pmatrix}, \text{ or } P = MA \tag{1}$$

where p is the microphone response, A is the amplitude of the first six resonant modes, and M is the matrix relating the microphone responses as the superposition of resonant modes. Inversely, the amplitude of the first six modes can be calculated from Equation (2)

$$A=(M^TM)^{-1}(M^TP) \tag{2}$$

The output of process 34 produces individual data streams for each of the six modes which are fed to the active noise cancellation processor 36 along with a data stream from the engine vibration sensor signal. These data streams carry amplitude and phase information, which is used by the active noise cancellation processor to compute output solutions for each of the control (cancellation) speakers 20. Excitation to each speaker can excite different resonant modes with various amplitudes, $$A=NY \tag{3}$$

Where A is the vector for the amplitude of each resonant mode, Y is the vector for the input to each speaker, and N is the matrix relating the modal response to speaker input.

Knowing the modal amplitude from equation (2), the inputs to each speaker can be calculated as $$Y=(N^TN)^{-1}(N^TA) \tag{4}$$

These output solutions are each fed to a respective channel of the multi-channel speaker driver 24 to drive the speakers. In one embodiment, the active noise cancellation processor uses a filtered-x least mean square (FxLMS) active noise cancellation algorithm. Other active noise cancellation algorithms may also be used.

As illustrated in FIG. 3, the overall active noise cancellation strategy has knowledge of the engine vibration (from the engine vibration sensor 30) and has knowledge of the acoustic response (from the error mics 26). The active noise cancellation algorithm thus computes what acoustic signal must be injected into the acoustic space to negate the noise being produced by the engine. The error mics 26 effectively hear all sounds that are present within the cabin acoustic space. Thus the engine vibration sensor 30 allows the system to discern which of those sounds correspond to the engine, and thus differentiate from desired sounds within the cabin, such as passengers communicating with each other, audio from an entertainment system, and announcements to passengers and crew made over the cabin communication system.

Process Flowchart—Encode and Decode

Figures 4A, 4B:
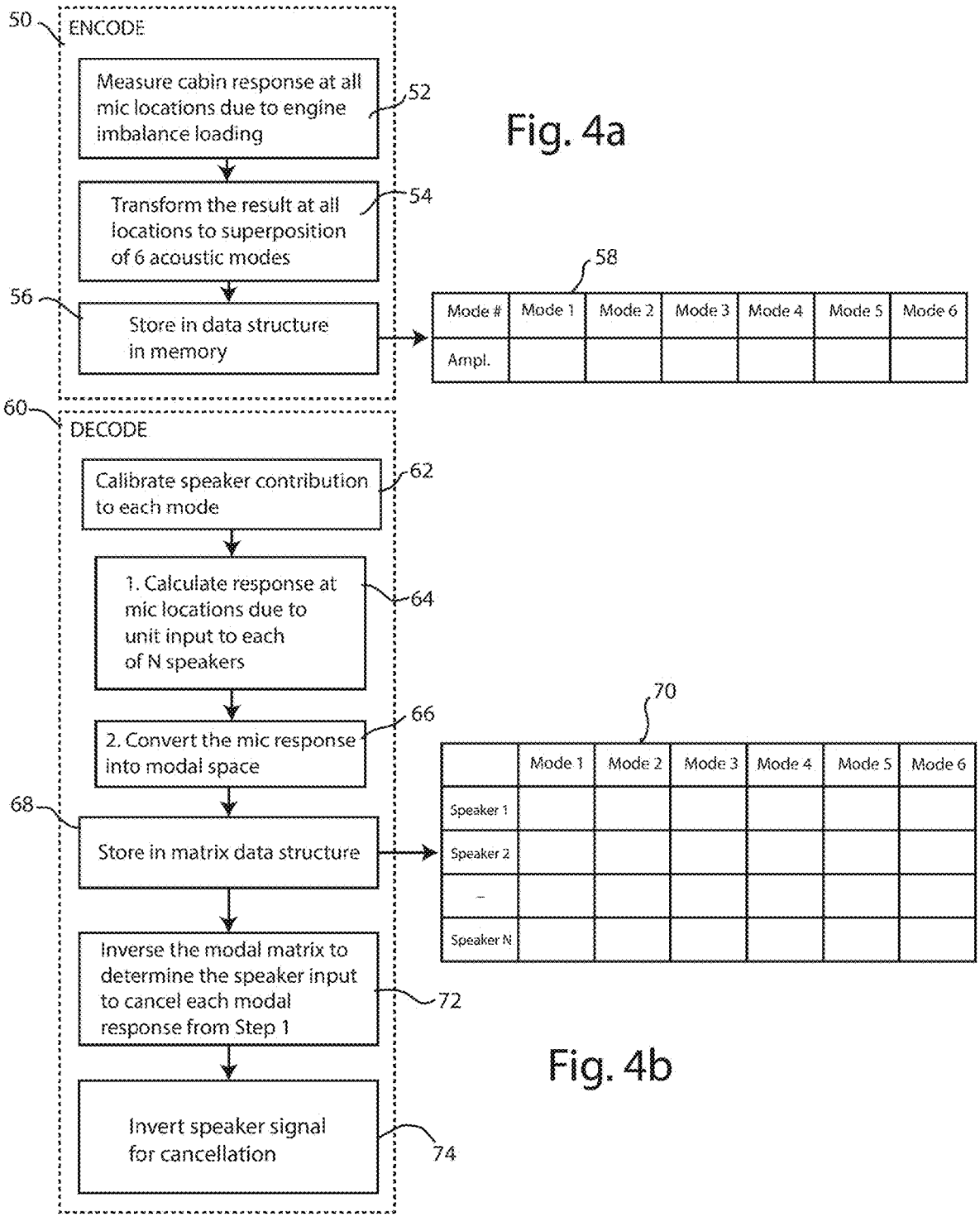
FIG. 4*a* is a flowchart depicting the encode process for calibrating the error mic sensors to the engine noise produced by engine imbalance loading.
FIG. 4*b* is a flowchart depicting the decode process for calibrating control speakers for each mode, converting the mic response into modal space and generating a matrix of inverse signals to cancel each modal response to engine noise.

FIGS. 4*a* and 4*b* show how the mode models for the microphones (FIG. 4*a*) and speakers (FIG. 4*b*) are constructed and used. The acoustic amplitude and phase information from the microphones are encoded for representation in modal space. This encode process, shown at 50, involves the following steps and corresponds to the time domain to mode space conversion process 34 (FIG. 2). First the cabin response at all mic locations to engine noise are captured at 52.

The measured cabin response data at 52 represent the acoustic sounds produced by vibrations of cabin walls and other surfaces in response to engine vibration and captured as digital audio data. These digital audio data are captured in a buffer and converted into a matrix which is transformed at 54 into acoustic space modal data representing the superposition of six acoustic modes (in the illustrated embodiment). Six acoustic modes are used as an example for implementation, however a greater or fewer number of modes may be implemented.

The acoustic mode microphone data are then stored in a matrix data structure in memory, as diagrammatically depicted at 58. In data structure 58, note that an amplitude (Ampl.) values are stored for each mode where it can be accessed by the active noise cancellation (ANC) processor 36 (FIG. 2) to compute a noise cancellation solution.

FIG. 4*b* shows the decoding process 60 that is used by the ANC processor 36 (FIG. 2) to compute noise cancelling solutions that are fed to each speaker 20 (FIG. 2) individually. In order to work accurately, the decoding models for each speaker are calibrated at step 62, which comprises sub-steps 64 and 66. As noted at 62, the contribution from each speaker to each mode is calibrated. This is accomplished as at 64 by feeding a unit input, such as a short test burst or impulse of acoustic energy into each speaker and capturing the response to that impulse at each mic location. These data are captured separately for each of the N speakers 20. The captured mic response data are then transformed, as at step 66, into modal space, using the same transformation algorithm used in step 54. These modal speaker calibration data are stored in the speaker matrix data structure 70 and provide the ANC processor 36 with the information on how a given sound pressure level produced by each speaker is heard by each microphone for a given mode.

To make most efficient use of this information, the speaker matrix values are inversed at 72 and multiplied with the amplitude vector 58 determined from the encoding phase.

Finally, at step 74, the ANC processor inverts the signals calculated from step 72 by 180 degree out of phase to determine the output for each speaker.

Figure 5:
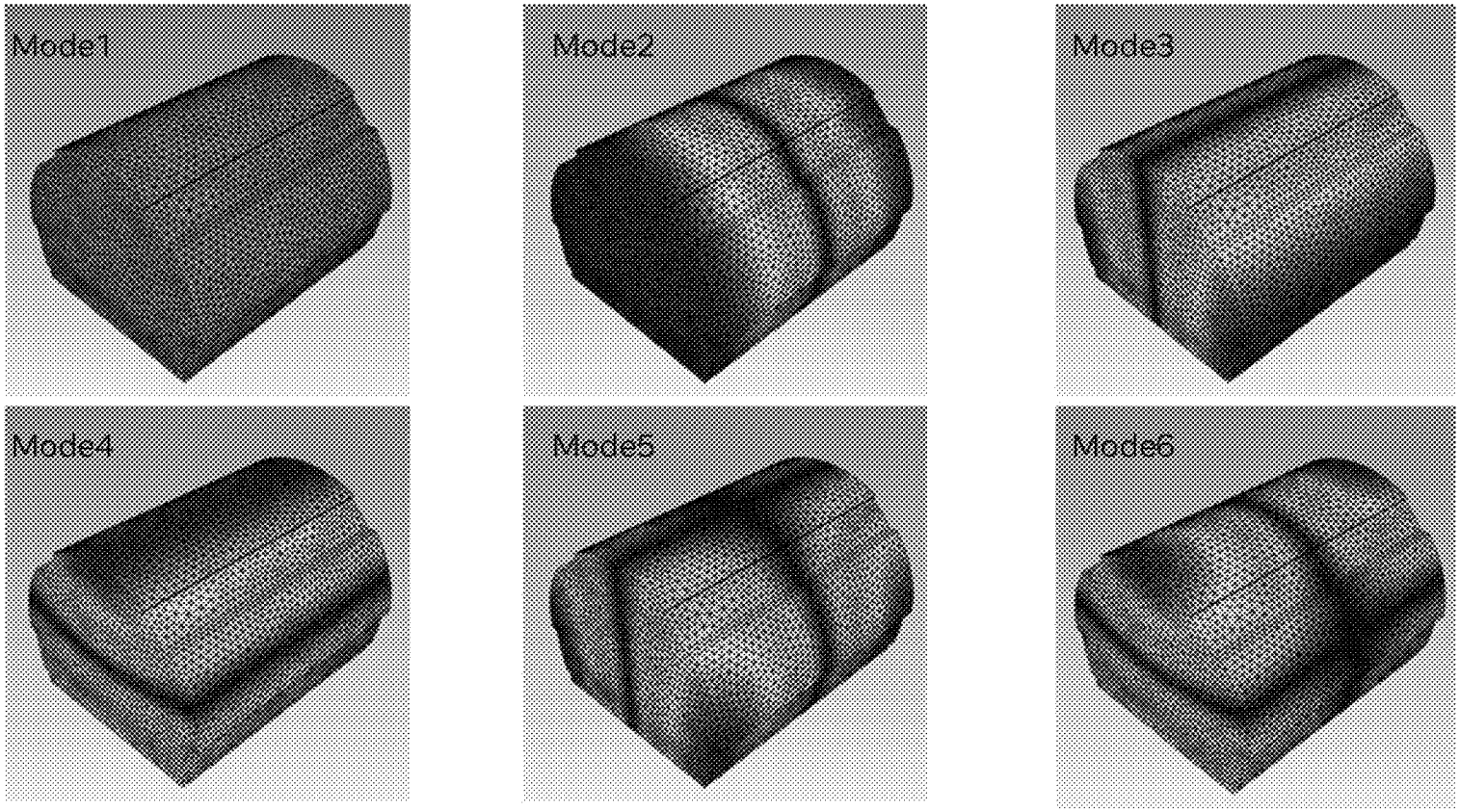
FIG. 5 is the exemplary series of mode diagrams also featured in FIG. 1.

In modal space the sounds produced for each mode are closely tied to the geometry of the cabin. The anti-nodes for each mode are located at specific positions within the cabin, and each mode has its own unique characteristic frequency and mode shape. Thus anti-node locations and characteristic frequencies for each of the modes are fixed. However, the sound pressure levels are not fixed. These rise and fall sinusoidally at the characteristic frequency, and the sound pressure level for a given mode at one place in the cabin may not necessarily be the same at another place in the cabin. This is illustrated in FIG. 5, which shows a simplified comparison of the six modes and the sound pressure levels existing simultaneously in forward and aft places within the cabin.

Phasing Considerations of Acoustic Signals

The overall blend of the active noise cancellation signals introduced into the cabin are an amalgamation of noise cancellation signals, specifically computed for each mode and for each speaker location. The active noise calculations each take into account the error mic data and the engine vibration sensor data in a manner that produces an optimized noise reduction for the entire cabin.

Figure 6:
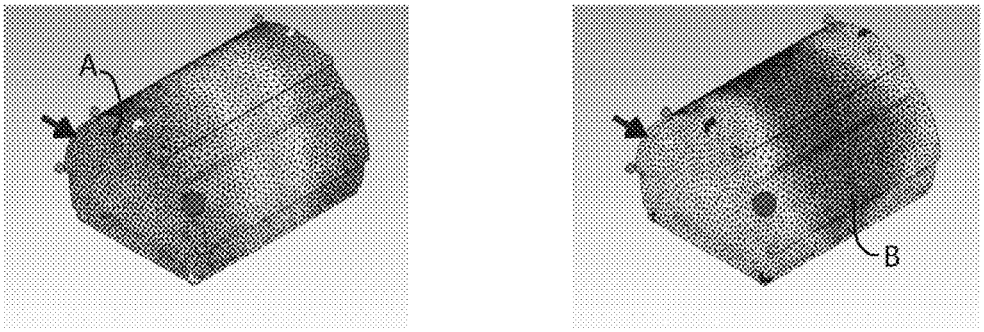
FIG. 6 is an exemplary heatmap diagram of Mode 2, illustrating the over-cancellation condition.

Because of the complex interrelationship of the modal sound pressure levels at each anti-node position, optimization is needed so that the active noise cancellation signal for one location does not overstimulate a given location, resulting in an increased perceived noise level for a different location. FIG. 6 illustrates such over-cancellation using conventional point-based ANC technology, where the pressure at the error mic location A were reduced too much at the sacrifice of the center location B where no microphone was present. This type of behavior should be avoided by the modal based method, but should be checked as precaution.

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment as contemplated herein. It should be understood that various changes may be made in the function and arrangement of elements described in an exemplary embodiment without departing from the scope of the invention as set forth in the appended claims.

What is claimed is:

1. An active noise cancellation system for reducing engine noise in an aircraft cabin, comprising:

the aircraft cabin having a geometric structure that defines a plurality of different resonant modes each having at least one anti-node which represents the position of maximum response for the given resonant mode;

an engine vibration sensor mechanically coupled to the aircraft or the engine to produce an engine vibration signal in response to engine vibration;

a plurality of error sensors positioned throughout the cabin at a first set of predetermined locations related to the at least one anti-node of the plurality of different resonant modes, the plurality of error sensors producing a plurality of time-varying sound pressure level signals;

a plurality of speakers positioned throughout the cabin at a second set of predetermined locations related to the at least one anti-node of the plurality of different resonant modes;

a conversion processor programmed to receive the time-varying sound pressure level signals and to produce a modal representation of information carried by the sound pressure level signals as a matrix of modal signals corresponding to each of the plurality of different resonant modes of the cabin;

an active noise cancellation processor programmed to operate on the modal signals and the engine vibration signal to compute individual noise cancellation solution signals fed to each of the plurality of speakers.

2. The system of claim 1 wherein the first set of predetermined locations are each proximate an anti-node of at least one of the plurality of different resonant modes.

3. The system of claim 1 wherein plurality of different resonant modes are selected from the group consisting of:

mode 1—a rigid body mode;

mode 2—a forward to aft resonant mode;

mode 3—a right hand to left hand resonant mode;

mode 4—an up to down resonant mode;

mode 5—a corner resonant mode; and mode 6—a high order mode different from modes 1 through 5.

4. The system of claim 1 wherein each mode has a different characteristic frequency.

5. The system of claim 1 wherein the active noise cancellation processor is programmed to perform a filtered-X least mean square (FxLMS) algorithm, a filtered-X normalized least mean square algorithm, a filtered-X sign-error least mean square algorithm, a filtered-X sign-data least mean square algorithm, a filtered-X sign-sign least mean square algorithm, a filtered-X recursive least mean square algorithm or a modified version of these algorithms.

6. A method for reducing engine noise in the cabin of an aircraft having at least one engine, comprising:

deploying a plurality of error microphones at predetermined locations within the cabin to produce error microphone response signals associated with the engine noise in the cabin;

obtaining inputs from at least one reference sensor coupled to at least one engine carried by the aircraft;

using a processor to code the error microphone response signals into an encoded modal response in the cabin through a coding matrix;

using a processor to apply an adaptive filter to determine a plurality of modal signals needed to cancel the encoded modal response in the cabin;

using a processor to decode the modal signals into speaker input signals through a decoding matrix;

sending the speaker input signals to a plurality of speakers to reduce the engine noise in the cabin.

7. The method of claim 6 wherein the adaptive filters are based on an FxLMS algorithm, a filtered-X normalized least mean square algorithm, a filtered-X sign-error least mean square algorithm, a filtered-X sign-data least mean square algorithm, a filtered-X sign-sign least mean square algorithm, a filtered-X recursive least mean square algorithm or a modified version of these algorithms.

8. The method of claim 6 wherein the speaker input signals are amplified to produce sound pressure levels sufficient to substantially acoustically cancel the encoded modal response in the cabin.

9. The method of claim 6 wherein the plurality of error microphones are deployed at predetermined locations corresponding to at least one anti-node of the plurality of different resonant modes defined by the geometric structure of the cabin.

10. A method of reducing engine noise in the cabin of an aircraft, comprising: identifying a location within the cabin of at least one anti-node for each of a plurality of different resonant modes;

obtaining an engine vibration signal from an engine vibration sensor attached to the aircraft;

producing a plurality of time-varying sound pressure level signals using a plurality of error sensors positioned throughout the cabin at a first set of predetermined locations related to the at least one anti-node of the plurality of different resonant modes, the plurality of error sensors producing a plurality of time-varying sound pressure level signals;

using a processor to convert the time-varying sound pressure level signals into a matrix of modal signals corresponding to each of the plurality of different resonant modes;

supplying the engine vibration signal and the modal signals to an active noise cancellation processor programed to compute and supply individual noise cancellation solution signals to a plurality of speakers deployed throughout the cabin at a second set of predetermined locations related to the at least one anti-node of the plurality of different resonant modes.

11. The method of claim 10 wherein the plurality of time-varying sound pressure level signals are encoded by:

a. measuring cabin response at all error sensor locations due to engine noise;

b. transforming the measured cabin response at all error sensor locations to a superposition of the plurality of different resonant modes.

12. The method of claim 10 further comprising calibrating the contribution to each mode for each of the plurality of speakers.

13. The method of claim 12 wherein calibrating is performed by:

a. calculating a response at a mic location due to a unit input to each of the plurality of speakers individually;

b. converting the calculated response into modal space and storing in a matrix data structure.

14. The method of claim 13 further comprising:

c. computing the inverse of the modal matrix to determine a speaker input that will cancel each modal response;

d. adding all modal inputs to each speaker to determine the overall input to each speaker.

* * * * *